United States Patent [19]

Huckaby

[11] 4,362,478

[45] Dec. 7, 1982

[54] BYPASS VALVE FOR SUCKER ROD PUMPS

[76] Inventor: Leonard L. Huckaby, P.O. Box 152, Wayne, Okla. 73095

[21] Appl. No.: 228,064

[22] Filed: Jan. 26, 1981

[51] Int. Cl.[3] ..... F04B 21/00; F04B 39/00

[52] U.S. Cl. ..... 417/434; 417/443; 417/554; 166/105; 166/332; 166/373

[58] Field of Search ..... 417/434, 443, 554; 166/68, 105, 112, 316, 332, 373, 386

[56] References Cited

U.S. PATENT DOCUMENTS

| | | | |
|---|---|---|---|
| 2,363,290 | 11/1944 | Birdwell | 417/434 X |
| 2,663,261 | 12/1953 | Gage | 417/434 X |
| 2,674,198 | 4/1954 | Howe | 417/434 X |
| 2,720,839 | 10/1955 | Chenault | 417/434 |
| 2,997,963 | 8/1961 | Hatcher | 417/434 X |
| 3,140,668 | 7/1964 | Breaux | 417/434 |
| 4,166,715 | 9/1979 | Huckaby | 417/434 |

*Primary Examiner*—Ernest R. Purser

*Assistant Examiner*—Joseph Falk

*Attorney, Agent, or Firm*—Ralph B. Pastoriza

[57] ABSTRACT

A pipe section with an exteriorally secured valve body is arranged to be inserted in a lower portion of a well pipe string containing sucker rods and a lower pump, the pipe section and valve body being disposed slightly above the pump itself. A lateral pin passes through a connecting bore between the pipe section and valve body and is arranged to be urged in a lateral direction to operate the valve when the sucker rods are moved beyond their normal stroke within the pipe string. Opening of the valve serves to place the column of fluid in the well pipe string into communication with the well annulus and thereby permit emptying the pipe string of the fluid column and thus permitting the pipe to be pulled for repairing the pump or for other operations without the disadvantage of the heavy hydrostatic pressure resulting from the fluid column.

3 Claims, 3 Drawing Figures

BYPASS VALVE FOR SUCKER ROD PUMPS

This invention relates generally to oil well operations and more particularly to a special bypass valve assembly for positioning in a pipe string incorporating sucker rods for operating a pump in order to place the interior of the pipe string into communication with the well annulus and thereby permit emptying the pipe string of the fluid. As a consequence, the hydrostatic pressure is equalized. This operation is sometimes referred to as hydrostatic unloading or "dumping".

BACKGROUND OF THE INVENTION

In order to pump oil from a well in which casing has been set, the casing is perforated by a suitable gun at those levels at which oil has been indicated to exist. After the casing has been perforated, a pump is lowered on the end of the conventional drill pipe string to this particular level. The pump includes a pumping tube hereafter referred to as a pump barrel within which a reciprocating plunger operates. This plunger is driven by sucker rods extending upwardly through the pipe string to the surface of the well. Oil is pumped from the lower well annulus adjacent to the perforations in the casing up through the well tubing or pipe string to the surface of the well.

After pumping has been completed, or if it is desired to change the pump or repair it, it is necessary to pull the pipe string or tubing to bring the pump to the surface. Since, however, the oil well pipe string is filled with oil throughout the length of the tubing, whereas the surrounding oil in the well annulus defined between the exterior of the pipe string and interior of the casing is at a relatively low level, there exists a very large pressure differential rendering it extremely difficult to unseat the pump to remove the same or to pull the pipe string.

The foregoing condition can be overcome if the fluid or oil within the pipe string could be passed in a reverse direction to the annulus exterior of the pipe string. If the fluid could be passed in this manner, the large hydrostatic head created within the well tubing string could be "dumped" into the surrounding annulus of the well and thus equalize the pressure involved so that removal of the tubing or well string without the large hydrostatic head of oil could be readily achieved.

My U.S. Pat. Nos. 3,168,873 issued Feb. 9, 1965; 4,047,853 issued Sept. 13, 1977 and 4,157,117 issued June 5, 1979 all relate to hydraulic unloading devices which solve the foregoing problem. However, the solutions described in these patents all involve special components, ports, and the like not normally provided in the conventional pipe string for providing the reversed flow path when "dumping" is to take place. These ports can become clogged by sand and thus rendered ineffective. In addition, while my latest patent is adaptable to a special type of pump known as the "HOPS" pump, my earlier patents do not describe systems which could be used on such a pump.

It would be advantageous if an appropriate hydraulic unloading system or bypass valve assembly could be provided which is not subject to clogging by sand and which is adaptable to all types of oil well pipe strings incorporating a pump operated by sucker rods.

BRIEF DESCRIPTION OF THE PRESENT INVENTION

Bearing the foregoing in mind, the present invention contemplates an improved bypass valve assembly for sucker rod pumps especially designed for ready insertion into any conventional oil pipe string incorporating sucker rods in a pump and wherein the design is such that problems of ports in the pipe string itself or even in the portion substituted into the pipe string through which the fluid passes to the annulus are avoided so that sanding up or clogging is avoided.

More particularly, my bypass valve includes a valve body including a valve arranged to be secured to an exterior portion of a pipe section receivable in the lower portion of the well pipe string. The valve body is in communication with the interior of the pipe string. Means in turn extend from the interior of the pipe string into the valve body responsive to movement of the sucker rods beyond their normal stroke which movement functions to open the valve in the valve body and thereby pass fluid from the interior of the pipe string to the well annulus. The pipe string can thus be relieved of the column of fluid through the valve from the surface of the well by controlling the stroke of the sucker rods. Since the valve is exterior of the main pipe string and inserted pipe section, there is minimum interference with normal sucker rod and pump operation and there are not required directly exposed bores or openings to the annulus through the pipe string or inserted pipe section.

BRIEF DESCRIPTION OF THE DRAWINGS

The foregoing as well as further features and advantages of this invention will be better understood by now referring to the accompanying drawings in which.

DETAILED DESCRIPTION OF THE INVENTION

Figure 1:
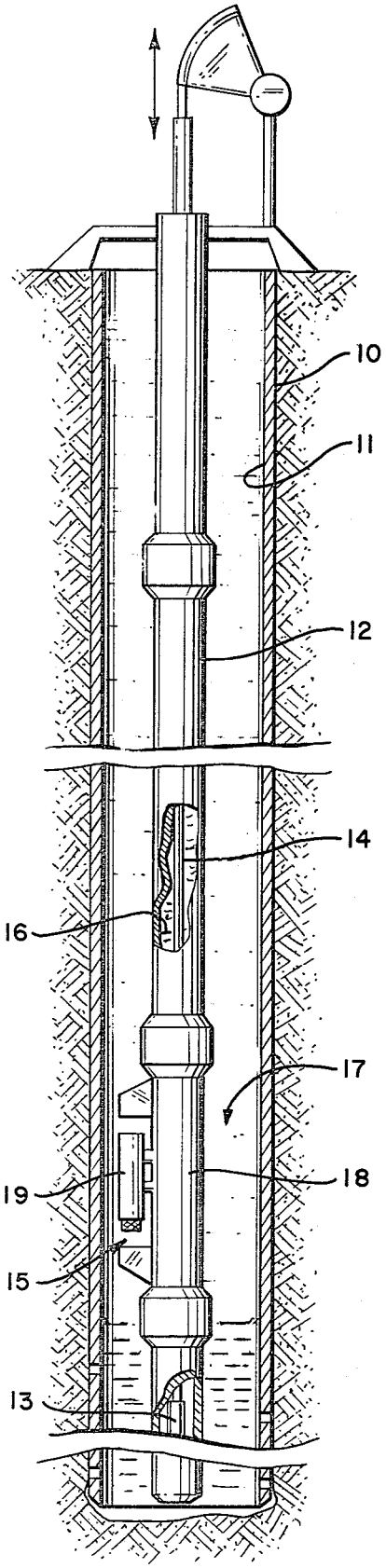
FIG. 1 is a cross section of a typical oil well incorporating a pipe string and pump wherein the bypass valve assembly has been incorporated in the string itself.

Referring first to FIG. 1, there is shown a typical oil well 10 in which casing has been set as indicated at 11. A pipe string 12 is shown extending down the well, the extreme lower end of the pipe string incorporating a pump schematically indicated at the broken away portion at 13. This pump is juxtaposed appropriate perforations shown in the casing 11. This pump 13 is arranged to be operated by sucker rods, a portion of the sucker rods being indicated in the broken away portion 14 in the central part of the pipe string in FIG. 1.

The bypass valve assembly in accord with the present invention is indicated generally by the numeral 15 in FIG. 1 and is arranged to be inserted between threaded joints of the pipe string 12 in the lower portion of the pipe string above the pump 13. Essentially, the valve assembly is arranged to place the fluid column within the pipe string 12 as indicated at 16 into communication with the well annulus; that is, the space between the exterior of the pipe string and the interior of the casing designated generally by the numeral 17. By so placing the fluid column in the pipe string into communication with the well annulus, the fluid can be "dumped" from the pipe string and thereby permit pulling of the string or easy removal of the pump.

Basically, and still referring to FIG. 1, the valve assembly 15 comprises a pipe section 18 arranged to be threadedly inserted between appropriate joints in the well pipe string 12 and a valve body 19 secured to a side and in communication with the pipe section 18.

Further details of the pipe section 18 and valve body 19 will now be described with respect to the enlarged cross section of FIG. 2.

Figure 2:
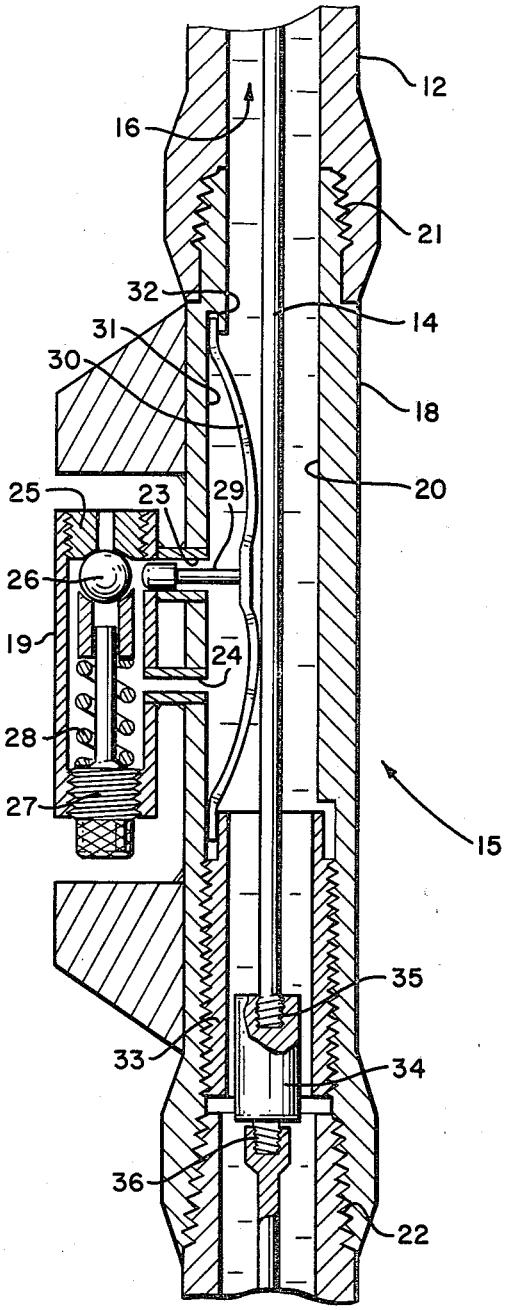
FIG. 2 is a greatly enlarged fragmentary cross section of the bypass valve assembly in its normally closed position; and, FIG. 3 is a detailed cross section of a portion of the valve assembly of FIG. 2 showing the valve in open position for unloading the column of fluid in the main pipe string.

In FIG. 2, the pipe section 18 has a central bore 20 with upper and lower threads 21 and 22 for connection into the joint in the oil pipe string as described. Pipe section 18 also includes first and second vertically spaced lateral bores 23 and 24 in its side walls, these bores passing in a protected manner directly to the interior of the valve body 19.

Valve body 19 itself includes a valve seat 25 and cooperating valve ball 26 juxtaposed the first lateral bore 23. It can be appreciated that removal of the ball 26 from the valve seat 25 will place the interior of the valve body 19 into communication with the interior bore 20 of the pipe section 18. Since this bore is now part of the oil pipe string through which the sucker rods 14 extend, the interior of the entire oil pipe string will be placed into communication with the well annulus 17 described in FIG. 1.

The ball 26 is held by a biasing force exerted through adjusting mechanism 27 and spring 28 onto the seat 25. The mechanism is such that by threading of the portion 27, the compression of the spring 28 can be increased to increase the force on the ball 26 and thereby assure that the same will remain in a position to close off the valve seat until a predetermined exterior pressure is exceeded.

In order to open the valve; that is, to unseat the ball 26, there is provided a laterally movable pin 29 passing through the first lateral bore 23 with one end juxtaposed to the ball 26 and its opposite end extending radially into the pipe section 18. A belly spring 30 is positioned in the pipe section 18 to extend vertically along an internal channel 31 to overlie this opposite end of the pin 29 as shown. The belly spring 30 is held at its upper and lower ends by means of an appropriate cavity 32 and a threaded sleeve 33, respectively. It will be appreciated that by removing the threaded sleeve 33 after the pipe section 18 has been removed from the pipe string permits disassembly of the belly spring and appropriate access to the lateral pin 29.

Still referring to FIG. 2, there is shown a tripping sub 34 connected between two sucker rods below the belly spring and of a diameter corresponding to the largest diameter portion of the pump assembly 13 described in FIG. 1. Essentially, the diameter of this tripping sub is such as to urge the lateral pin 29 radially outwardly when the tripping sub is pulled up past the belly spring by the sucker rods 14. Such outward lateral movement of the pin 29 will result in unseating of the ball 26 and thereby permit fluid in the pipe string to drain to the well annulus by way of the second lateral bore 24, interior of the valve body and through the valve seat 25.

Figure 3:
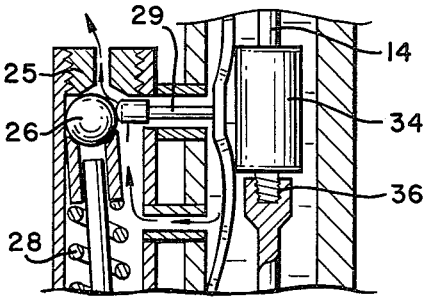

The foregoing operation wherein the valve is open is illustrated in FIG. 3 wherein the tripping sub 34 is shown in position after having moved the lateral pin 29 radially outwardly to unseat the ball 26.

It is to be understood that the tripping sub 34 can only be moved up to the belly spring to move the pin 29 laterally by exceeding the normal stroke of the sucker rods. In other words, normal pumping operations will not result in the tripping sub engaging the belly spring at all but only an intentional movement of the sucker rod beyond the normal stroke will effect operation of the lateral pin to open the valve.

When the tripping sub 34 is lowered to relieve the pressure on the belly spring, the biasing force exerted by the adjusting means 27 and spring 28 within the valve body 19 described in FIG. 2 will simply reseat the ball 26 on the valve seat 25. The sloping cavity of the valve seat will guide the ball 26 under pressure from the spring 28 into a central position on the seat to close off the valve.

Referring once again to the lower portion of FIG. 2, it will be noted that the tripping sub 34 is secured in the sucker rod string 14 by way of upper and lower threads 35 and 36. In accord with an important feature of this invention, the lower threads 36 are of a left-hand type. As a consequence, should the pump become jammed or inoperative in such a manner that it is not possible to pull up on the sucker rods because of the connection to the pump, by rotating the sucker rods in a clockwise direction, the sucker rods and tripping sub 34 can be disconnected threadedly at 36 from the remaining portion of the sucker rods. After such disconnection as a consequence of the left-hand threads, then the tripping sub 34 can be pulled upwardly to operate the lateral pin 29 as described to open the valve and permit unloading of fluid in the pipe string.

From all of the foregoing, it will be appreciated that operation of the valve can be effected from the surface of the bore hole by merely controlling movement of the sucker rods. Further, it can be appreciated that the pipe section 18 may be inserted anywhere in the pipe string although preferably the lower portion so that the maximum column of fluid can be drained. It will be understood that the tripping sub will be positioned within the sucker rod string in an appropriate position such that it can trip the valve or open the same only when the sucker rods are moved beyond their normal reciprocating stroke.

As a consequence of the two foregoing features, it will be readily appreciated that the bypass valve assembly of this invention is adaptable to any type of oil pipe string including sucker rods for operating the pump. There is no limitation imposed by the particular type of pump employed.

With respect to the foregoing, where a travelling barrel type pump is used and where the pipe section is placed close to the upper end of the travelling barrel type pump, the travelling barrel itself can serve the function of the tripping sub by pulling up on the pump beyond its normal stroke to engage the belly spring. In other words, for such travelling type barrel pumps, it is not essential that there be provided a tripping sub. The term "tripping sub" is meant to include a travelling type pump barrel as a "tripping sub" in this particular situation.

After draining, removal of the sucker rods and raising of the pipe string to bring the level of the bottom pump seat to the level of fluid in the annulus, the tripping sub can be removed from the sucker rods and lowered on a sand line from the rig to open the valve and drain out the trapped remaining fluid in the string.

From all of the foregoing, it will now be evident that the present invention has provided yet another reliable and rugged valve assembly permitting hydraulic unloading of fluid columns from the interior of an oil well pipe string.

I claim:

1. A bypass valve assembly for placing the interior of a pipe string above a pump operated by sucker rods in the string, in communication with the well annulus to thereby permit emptying of the pipe string of fluid, said assembly including, in combination:

(a) a pipe section having a central bore and upper and lower threads for connection into a joint in the oil pipe string, said pipe section further including bore means in its side wall (b) a hollow valve body mounted on the exterior of said pipe section in communication with said bore means and including a valve seat and ball seated on the valve seat juxtaposed the bore means, removal of the ball from the valve seat placing the interior of the pipe string into communication with said well annulus;

(c) adjustable means on said valve body for biasing said ball against said seat with a given force;

(d) a laterally movable pin passing through said bore means with one end juxtaposed said ball and its opposite end extending radially into said pipe section;

(e) a belly spring in said pipe section extending vertically along an internal side to overlie said opposite end of said pin; and (f) a tripping sub connected between two sucker rods below said belly spring and of a diameter such as to urge the pin radially outwardly when pulled up past the belly spring to thereby unseat the ball from said valve seat and permit fluid in the pipe string to drain to the well annulus by way of said bore means, interior of the valve body and through the valve seat.

2. An assembly according to claim 1, in which said tripping sub is positioned on the sucker rods such that the sucker rods must be pulled beyond their normal reciprocating stroke in order to operate said valve whereby operation of said valve can be carried out from the surface of the bore hole by means of said sucker rods.

3. An assembly according to claim 1, in which said tripping sub has upper and lower threaded connections to said sucker rods, the lower threaded connection being of a left-hand thread whereby rotation of sucker rods in a clockwise direction can effect unthreading of the remaining portion of the sucker rods from the lower end of said tripping sub to thereby separate the sucker rods and tripping sub from the pump and permit operation of the valve without interference from the pump should the pump become jammed or become inoperative.

* * * * *